United States Patent [19]

Nilson

[11] Patent Number: 4,693,306

[45] Date of Patent: Sep. 15, 1987

[54] REGULATOR MEANS FOR USE IN HEAT PIPES

[75] Inventor: Hans-Ove Nilson, Kallered, Sweden

[73] Assignee: AB Volvo, Gothenborg, Sweden

[21] Appl. No.: 834,211

[22] Filed: Feb. 27, 1986

[30] Foreign Application Priority Data

Mar. 4, 1985 [SE] Sweden ..... 8501033

[51] Int. Cl.[4] ..... F28D 15/00

[52] U.S. Cl. ..... 165/104.21; 165/104.19

[58] Field of Search ..... 165/104.19, 104.22, 165/104.21, 104.11; 237/67, 70

[56] References Cited

FOREIGN PATENT DOCUMENTS 909555 2/1982 U.S.S.R. ..... 165/104.22

*Primary Examiner*—Henry A. Bennet

*Attorney, Agent, or Firm*—Harness, Dickey & Pierce

[57] ABSTRACT

A heat pipe comprising means for regulating the transfer of steam heat. The heat pipe comprises a condenser part, an evaporator part and an interconnecting conduit extending between and joining together said two parts. The regulator means comprises a valve having a valve seat which is fixedly secured to the heat pipe and a valve body of a material having a different coefficient of thermal expansion than the material of the heat pipe. One part of the valve body is fixedly connected to the heat pipe. Another part of the valve body cooperates with the valve seat and together with said valve seat it delimits an opening gap in said valve the size of which varies in dependence of the degree of heating of the heat pipe.

2 Claims, 2 Drawing Figures

REGULATOR MEANS FOR USE IN HEAT PIPES

BACKGROUND OF THE INVENTION

The subject invention concerns a means for regulation of the transfer of heat in a heat pipe by means of an operative medium contained therein, said heat pipe comprising a heat-emitting condenser part, a heat-absorbing evaporator part and an interconnecting conduit joining the two parts together.

A heat pipe of this kind is known from DE-A No. 1 1 950 448. In order to regulate the heat transfer from the evaporator part to the condenser part by means of the operative medium a valve is inserted in the interconnecting conduit. The valve is in the form of a rotary disc which is actuated by mechanical or electromagnetic means from the exterior of the heat pipe. A radiator pipe of this construction is disadvantageous in several respects. The lead-through opening through the wall of the heat pipe, which is necessary to control the valve (rotation of the disc), tends to cause leakages with resulting reduction of the efficiency of the heat pipe. Leakages, in turn, may cause the rotating mechanism to jam or even to become inoperative, thus jeopardizing the operation and function of the heat pipe entirely.

SUMMARY OF THE INVENTION

The subject invention provides a heat pipe regulator means in which the drawbacks outlined in the aforegoing are eliminated in that the entire regulator means is built into the heat pipe and consequently, the heat pipe forms an entirely closed body. The invention is characterized therein that the regulator means is a valve having a valve seat which is fixedly connected to or forms an integral part of the inner face of the heat pipe and a valve body which is disposed inside the heat pipe and which is manufactured from a material having a different coefficient of thermal expansion than the heat pipe material, said valve body having one part which is fixedly secured to said heat pipe and a second part which is arranged to cooperate with the valve seat so as to define an opening gap of varying width inside the valve in dependence of the degree of heating of the heat pipe.

BRIEF DESCRIPTION OF THE DRAWINGS

The invention will be described in closer detail in the following with reference to the accompanying drawings, wherein.

DETAILED DESCRIPTION OF A PREFERRED EMBODIMENT

Figure 1:
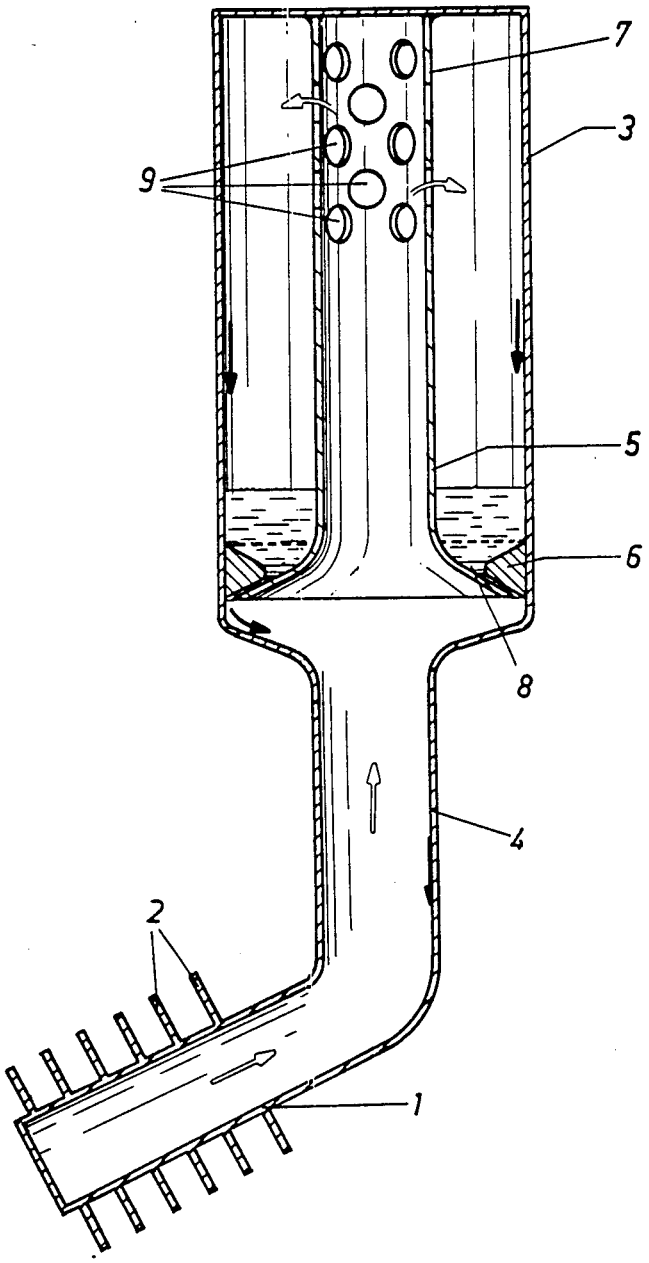
FIG. 1 is a longitudinal sectional view through a heat pipe in accordance with the invention.

The heat pipe illustrated in FIG. 1 consists of one evaporator part 1 having fins 2 thereon to increase the heat absorption one condenser part 3 and an interconnecting conduit 4 joining the two parts together. The condenser part 3 forms a valve housing in which a valve is disposed. The valve comprises a valve body 5 in the form of a tube, and a valve seat 6 in the form of an annular flange formed on the inner face of the condenser part 3. The upper portion 7 of the tubular valve body 5 is integrally connected to the condenser part 3 and the valve body bottom portion is provided with a collar member 8 designed to cooperate with the valve seat 6. At its upper part the valve body 5 is formed with a number of apertures 9 through which the evaporated operative medium, rising from the evaporator part 1, may pass into the condenser part 3.

The valve body 5 is made from a material having a different coefficient of thermal expansion than the heat pipe (condenser part 3). Opening and closing of the valve is a function of the temperature of the heat pipe (condenser part 3) and of the temperature of the valve body 5, and in dependence thereof the collar 8 on the valve body will delimit a larger or smaller opening gap relative to the valve seat 6.

Figure 2:
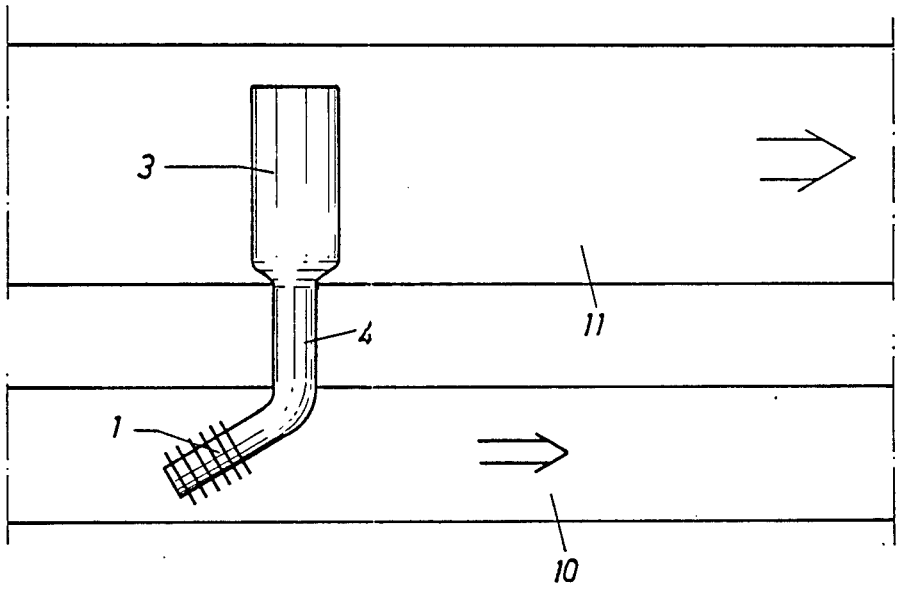
FIG. 2 is a schematical representation of one example of application of the heat pipe.

A heat pipe may be used e.g. in a motor vehicle in order to transport heat, as is illustrated in FIG. 2, from a hotter medium, such as the exhaust gases from the exhaust pipe 10 of the motor vehicle, to a cooler medium, such as the cooling water inside the coolant line 11 from the vehicle motor for the purpose of supplying additional heat to the passenger compartment of the vehicle. In this case, the evaporator part 1 of the heat pipe is disposed in the exhaust pipe 10 and its condenser part 3 in the coolant line 11.

In accordance with the embodiment illustrated the heat pipe is manufactured from steel and the valve body 5 from a nickel-iron alloy having a coefficient of expansion which is about a fifth of that of steel. When the hot exhaust gases flow past the evaporator part 1 the operative medium contained therein in liquid form, usually water, is evaporated and the steam rises through the interconnecting conduit 4 and further upwards inside the valve body and flows out through the apertures 9 in the condenser part 3. The steam deposits on the inner faces of the condenser part 3 in the form of condensation and is drained through the opening gap formed between the valve seat 6 and the collar 8 and flows further downwards along the inner walls of the interconnecting conduit 4 and back into the evaporator part 1 where it is again evaporated.

The steam successively heats both the condenser part 3 and the valve body 5. As a result, the condenser part 3 increases in length more rapidly than does the valve body 5 as a consequence of their different coefficients of thermal expansion. The result is that the opening gap narrows and in time will be closed entirely. When this happens and condensate no longer flows back to the evaporator part 1, no evaporation will occur and therefore the condenser part 3 will no longer be heated. Instead, the condenser part 3 will cool down by the cooling water circulating around it. The condenser part 3 therefore will contract, an opening gap will again be formed, liquid will flow down into the evaporator part 1 and the evaporation process therein will start again.

Thus, the regulator means in accordance with the invention is used to regulate the thermal flow in the heat pipe in such a manner that the cooler medium, that is, the cooling water, is never heated above a predetermined temperature and the hotter medium, that is the exhaust gases, are not cooled below a predetermined temperature. The regulator means prevents free liquid flow from the cooled part of the heat pipe the condenser part 3, to the heated part of the radiator pipe the evaporator part 1 whereby the contents of operative medium in liquid phase inside the heat pipe is collected in an unheated part of the pipe.

The regulator means in accordance with the invention provides automatic control of the evaporation and condensation processes. The regulator means is entirely built into the heat pipe and the latter therefore forms a completely closed body. All sealing problems inherent in regulatiing devices extending through the walls of the heat pipe thus are eliminated by means of the subject invention.

The regulator means may be shaped in several other ways than that shown and described. The condensate may be collected elsewhere in the heat pipe than in the location shown. In accordance with the embodiment described in the aforegoing the thermal flow may be regulated in dependence of the temperature of the heated (cooler medium). Should one wish to regulate it in dependence of the temperature of the heating (warmer) medium the valve body 5 and the valve seat 6 are positioned in a corresponding manner adjacent the evaporator part 1.

What I claim is:

1. An improved regulator means for regulating the transfer of heat inside a heat pipe by means of an operative medium contained inside said pipe, said heat pipe comprising a heat emitting condenser part, a heat-absorbing evaporator part and an interconnecting conduit extending between said two parts, the improvement comprising a valve forming said regulator means, said valve having a valve seat fixed relative to an inner face of said heat pipe and defining a flow opening, and a valve body which is disposed inside said heat pipe and formed from a material having a different coefficient of thermal expansion than the heat pipe material, a first part of said valve body being fixedly secured to said heat pipe at a point spaced from said valve seal and a second part of said valve body being juxtaposed to said valve seat and defining therewith an opening gap of varying area inside said valve in dependence of the degree of heating of said heat pipe.

2. An improved regulator means as claimed in claim 1, wherein said valve seat forms an annular flange on the inner face of said condenser part, said valve body being a tube positioned in the interior of said condenser part, said tube allowing passage therethrough of said operative medium from said evaporator part into and through said condenser part, one end of said valve body tube being fixedly connected to said condenser part, a collar formed on the opposite end of said valve body tube, said collar and said annular flange delimiting between them an opening between said condenser part and the rest of said heat pipe.

* * * * *